United States Patent [19]

Bishop

[11] 4,276,240

[45] Jun. 30, 1981

[54] CARBURETOR

[75] Inventor: Gerald B. Bishop, Dearborn, Mich.

[73] Assignee: Ford Motor Company, Dearborn, Mich.

[21] Appl. No.: 106,114

[22] Filed: Dec. 21, 1979

[51] Int. Cl.[3] ..... F02M 1/10

[52] U.S. Cl. ..... 261/52

[58] Field of Search ..... 261/52

[56] References Cited

U.S. PATENT DOCUMENTS

| | | | |
|---|---|---|---|
| 2,163,904 | 6/1939 | Winkler | 261/52 |
| 3,006,618 | 10/1961 | Carlson et al. | 261/52 |
| 3,151,189 | 9/1964 | McSeveny | 261/52 |
| 3,248,096 | 4/1966 | Ball | 261/52 |
| 3,291,462 | 12/1966 | Mennesson | 261/52 |
| 3,929,942 | 12/1975 | Harrison et al. | 261/52 |
| 3,943,206 | 3/1976 | Schubeck | 261/52 |
| 3,962,379 | 6/1976 | Freismuth et al. | 261/52 |
| 4,008,297 | 2/1977 | Nartowski | 261/52 |

*Primary Examiner*—Tim R. Miles

*Attorney, Agent, or Firm*—Robert E. McCollum; Clifford L. Sadler

[57] ABSTRACT

A carburetor has a fast idle cam with at least two steps being progressively engageable by a throttle stop or abutment secured to the throttle shaft when the chock valve is closed; a lost motion linkage connecting the choke valve and fast idle cam permitting this action to provide for a cold engine start and the coldest fast idle cam setting with the throttle valve idle speed setting at the greatest opening, and a second cold start at a fast idle cam setting intermediate the coldest and a warm setting, to permit the throttle valve to be located in a less open idle speed setting but greater than the normal warm engine setting.

3 Claims, 3 Drawing Figures

CARBURETOR

Figure 1:
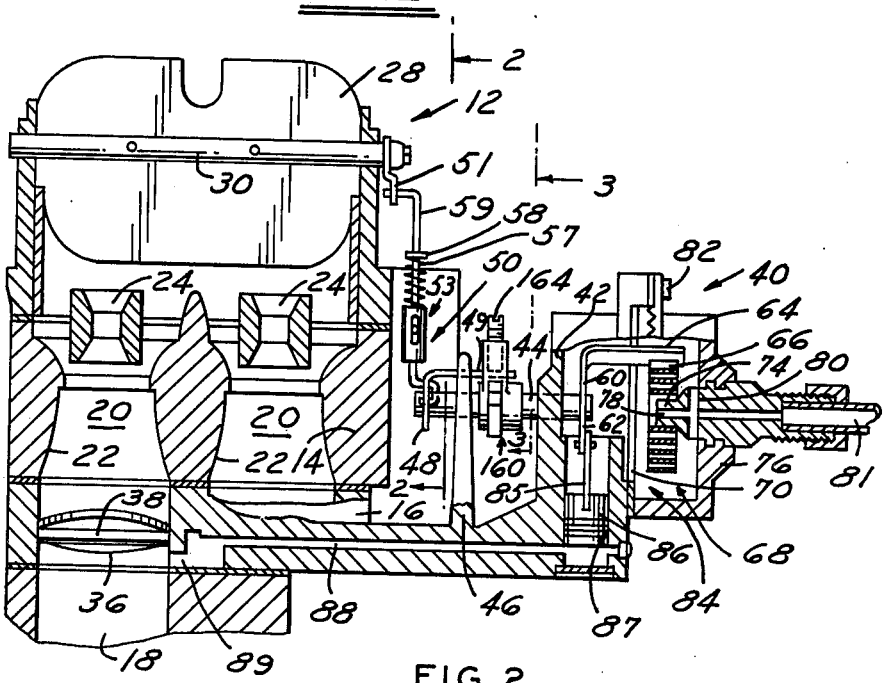

This invention relates in general to a carburetor for a motor vehicle. More particularly, it relates to a carburetor that provides more than just the one high cam engine starting position usually associated with the conventional fast idle cam.

Most commercial type motor vehicle carburetors equipped with cold enrichment systems include a fast idle cam. The cam is usually moved by a thermostatically responsive coiled spring to project more and more into the path of closing movement of the throttle plate shaft as the temperature becomes colder to provide richer than normal air/fuel mixtures for cold engine operation. The cam usually has a single high cam radially projecting step for cold engine starting, followed sequentially, for progressive engagement as the temperature increases, by a number of lesser projecting steps.

In the conventional carburetor having an air movable choke plate, the plate usually is positioned closed for cold engine starts and the throttle plates are moved slightly open from the normal engine idling speed position. This lessens airflow through the choke valve to increase the vacuum fuel metering signal to draw in enough extra fuel to provide sufficient vapor for starting the engine. Once the engine fires, however, the choke plate is cracked open slightly, and the more open than normal throttle plates permit the engine to draw in enough fuel and air to raise the engine cranking speed of say 100 r.p.m. to say 1000 r.p.m. fast idle speed to sustain engine operation. Once the engine running operation is attained, then the overrich starting mixture no longer is required, and it becomes desirable to reduce the throttle plate openings to a lower setting, but still one that is richer than that which provides the normal idle speed when the engine has warmed up.

The position of the throttle plate therefore, is important. The more it is cracked open from the closed position during engine cranking operations, the greater the volume of air and fuel inducted. Therefore, for engine starts, the throttle valve stop generally is always scheduled to be located against the high step of the fast idle cam to provide the richest cranking air/fuel mixture. This generally is accomplished by connecting the choke valve and fast idle cam with a linkage that will permit positioning of the fast idle cam on the high cam step when the choke valve is moved to the closed engine starting position.

As stated above, the conventional carburetor choke mechanism provides only a single high cam step position for all cold starting purposes, whether the temperature is 80° F. or −20° F., with a number of lower steps to be progressively engaged as the engine warms, to gradually decrease the engine speed to a normal idle setting. Obviously, there is some temperature level when the degree of throttle opening provided by the high cam step provides the best rich air/fuel mixture. Off this setting in either direction, therefore, the mixture is generally not rich enough or too rich.

Accordingly, it is an object of this invention to provide a throttle plate positioner that provides a variable number of fast idle cam positions for engine starting purposes.

It is another object of the invention to provide a throttle plate positioner that provides additional throttle plate openings during cold starting operations that vary as a function of the position of the fast idle cam.

Choke mechanisms are known in which more than one position of the fast idle cam is obtainable for engine starting purposes. For example, U.S. Pat. No. 3,943,206, Schubeck, shows and describes a finger mechanism 254 for insertion between the throttle stop 234 and the step of the fast idle cam 224, for starting the engine. Once the engine is started, the finger is withdrawn and the throttle stop then engages whichever cam step is aligned with it as determined by the thermostatic spring controlling rotation of the fast idle cam. However, in this case, the fast idle cam is not connected to a choke valve, but only to a needle valve that moves to control enrichment fuel flow.

Similarly, U.S. Pat. No. 3,929,942, Harrison et al, shows a mechanism that allows engine starting at various idle cam settings, but does not control a choke valve.

A further object of the invention, therefore, is to provide an expandible linkage means connecting the choke valve to the fast idle cam to permit the cam to be in either of a pair of positions, for engine starting purposes, when the choke valve is in a closed position.

A further object of the invention is to provide a lost motion connection between the choke valve and the fast idle cam mechanism of a carburetor that permits one engine starting position of the fast idle cam when the choke valve is closed, and permits a movement of the cam to a second engine starting position without a further movement of the choke valve.

Figure 2:
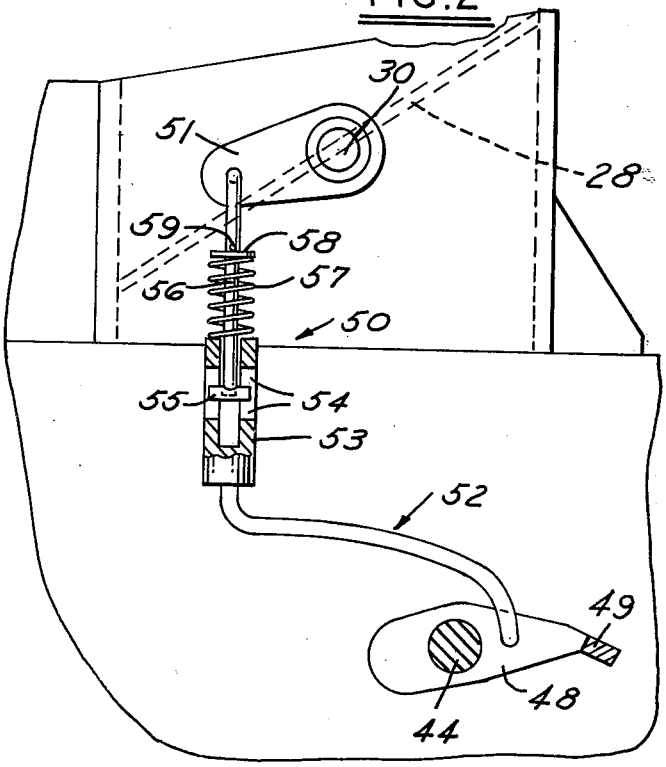
Figure 3:
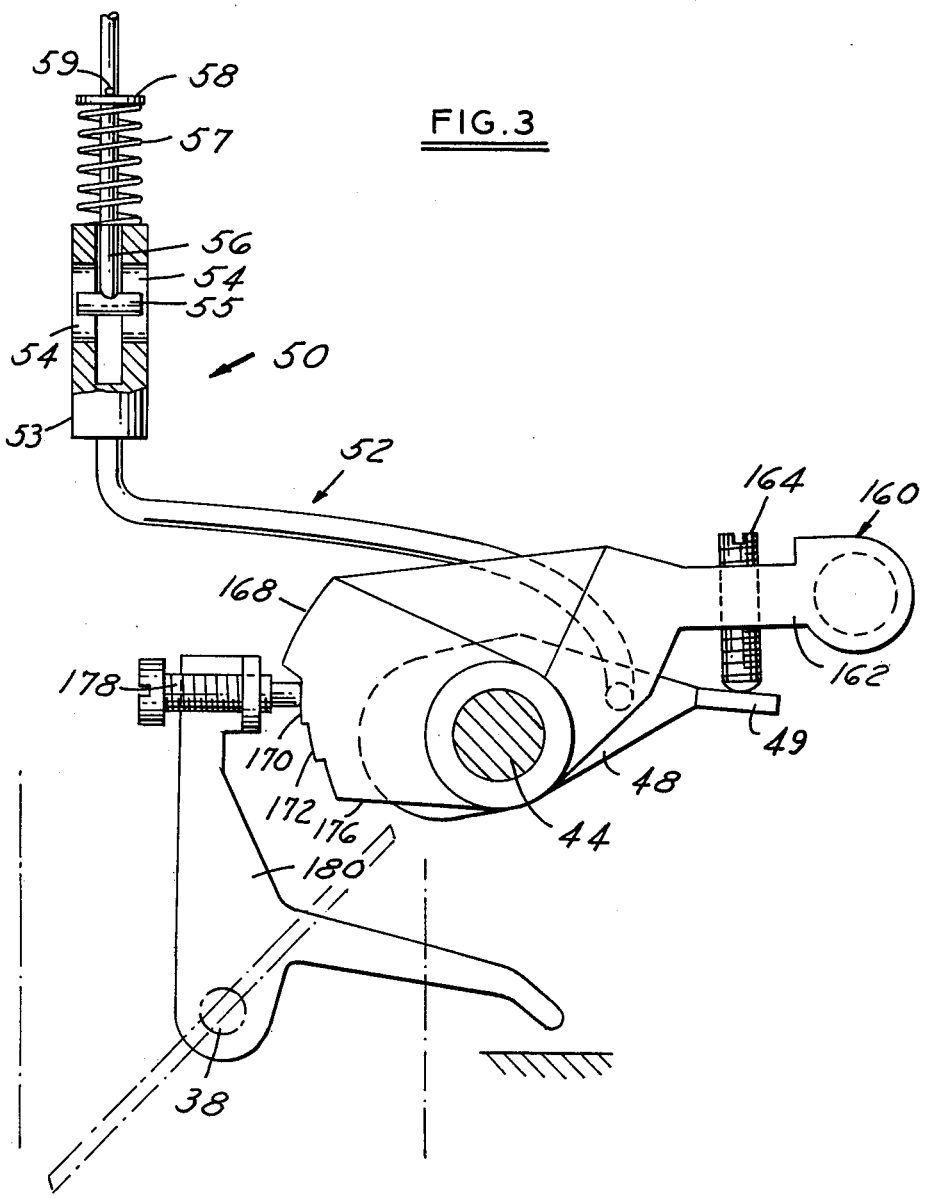

Other objects, features and advantages of the invention will become more apparent upon reference to the succeeding detailed description thereof, and to the drawings illustrating the preferred embodiment thereof, wherein:

FIG. 1 is a cross-sectional view of a portion of a carburetor embodying the invention; and, FIGS. 2 and 3 are side elevational views, with parts broken away and in section, of portions of the FIG. 1 showing taken on planes indicated by and viewed in the direction of the arrows 2—2 and 3—3 of FIG. 1.

FIG. 1 is obtained by passing a plane through approximately one-half of a known type of two-barrel, downdraft carburetor. It includes an air horn section 12, a main body portion 14, and a throttle body 16 secured together by suitable means, not shown, over an intake manifold indicated partially at 18 leading to the engine combustion chambers.

Main body portion 14 contains the usual air/fuel mixture induction passages 20 having fresh air intakes at the air horn ends, and connected to manifold 18 at the opposite ends. The passages are each formed with a main venturi section 22 in which is suitable mounted a boost venturi 24.

Air flow into passages 20 is controlled by a choke valve 28 that is unbalance mounted on a shaft 30. The shaft is rotatably mounted in side portions of the carburetor air horn, as shown. Flow of the usual fuel and air mixture through each passage 20 is controlled by a conventional throttle valve 36 fixed on a shaft 38 rotatably mounted in the throttle body 16. The throttle valves are rotated in the usual manner by depression of the vehicle accelerator pedal, and move from idle speed closed positions to positions essentially at right angles to that shown.

Choke valve 28 also rotates from a closed position to the nearly vertical, essentially inoperative position shown. In this latter position, the choke valve provides the minimum obstruction to airflow. The rotative position of choke valve 28 is controlled in part by a semiautomatically operating choke mechanism 40. The latter includes a hollow housing portion 42 that is cast an an integral extension of the carburetor throttle body 16. The housing is apertured for rotatably supporting one end of a choke valve control shaft 44, the other end of which is rotatably mounted in a support post 46. A bell-crank-type lever 48 fixed on the left end portion of shaft 44 is pivotally connected by the linkage means 50 of the invention to a lever 51 fixed on choke valve shaft 30.

As seen more clearly in FIG. 2, the linkage means 50 consists of a lower link 52 bent at its lower end to be received in a hole in lever 48. The upper part of link 52 is formed as a U-shaped yoke 53 with a pair of aligned slots 54 in the two legs. The slots slidably receive the laterally extending ends 55 of an upper rod or link 56 that is pivotally connected to choke valve shaft link 51. A spring 57 is located between the upper edges of the legs of yoke 53 and a washer type seat 58 located against a pin 59 on rod 56. The spring 57 in its free state is as shown, separating the upper and lower links 56 and 52. That is, the linkage means in effect is an extendible-contractible, lost motion type linkage, as will be explained more fully later.

The rightward end of shaft 44 in housing 42 has fixed on it one leg 60 of an essentially L-shaped thermostatic spring lever 62. The other lever leg portion 64 is secured to the end 66 of a thermostatically responsive, bimetallic, coiled spring element 68 through an arcuate slot, not shown, in an insulating gasket 70. The inner end portion of the coiled spring is fixedly secured on the end of a nipple 74 formed as an integral portion of a choke cap 76 of heat insulating material. Nipple 74 is bored as shown to provide hot air passages 78 and 80 connected to an exhaust manifold heat stove, for example, by a tube 81. Cap 76 is secured to housing 42 by suitable means, such as the screw 82 shown, and defines an air or fluid chamber 84.

As thus far described, it will be clear that the thermostatic spring element 68 will contract or expand as a function of changes in temperature of the air entering tube 81, or, if there is no flow, the ambient temperature of the air within chamber 84. Accordingly, changes in temperature will rotate the spring lever 62 to rotate shaft 44 and lever 48 in one or the other directions, as the case may be.

The leg 60 of lever 64 is pivotally fixed to the rod 85 of a choke pulldown piston 86. The latter is movably mounted in a bore 87 in housing 42. The under surface of piston 86 is acted upon by vacuum in a passage 88 that is connected to one of the carburetor main induction passages 20 by a port 89 located just slightly below throttle valve 36. Piston 86, therefore, is always subject to the vacuum existing in the intake manifold passage portion 18.

The start of a cold engine requires a richer mixture than that of a warmed engine because less fuel is vaporized. Therefore, the choke valve must be shut or nearly shut to restrict air flow and increase the pressure drop across the fuel inlet to draw in more fuel and less air. Once the engine does start, however starts, the temperature of the air in slightly to lean the mixture to prevent engine flooding as a result of an excess of fuel.

The choke echanism described above automatically accomplishes the action described. That is, on cold weather starts, the temperature of the air in chamber 84 will be low so that the outer end of spring element 68 will move circumferentially. This will rotate lever 48 in a counterclockwise direction and move linkage means 50 upwardly as a unit to move choke plate 28 to a closed position. The spring 57 being in its free state will act in effect as a solid link to transmit the upward push of link 52 to rod 56 through plate 58 to close the choke plate. Upon cranking the engine, vacuum in passage 88 will not be sufficient to move piston 86 to open the choke valve. Accordingly, the engine will be started with a rich mixture. As soon as the engine is running, however, the higher vacuum lever in passage 88 now moves piston 86 downwardly to rotate shaft 44 and lever 48 a slight amount clockwise. This will pull down the lower part of link 52, allowing the upper rod 56 to fall and the choke plate to be pushed open slightly by airflow against it.

During cold engine operation, it is also necessary to open the throttle valve wider to allow enough extra air/fuel mixture into the engine to prevent it from stalling due to the extra friction, greater viscosity of the lubricant, etc. As best seen in FIGS. 1 and 3, rotatably mounted on shaft 44 is a conventional fast idle cam 160. The cam has a projection 162 on one side in which is adjustably mounted a screw 164. The screw has a one-way engagement with a finger or tab 49 that is integral with and projects laterally from the choke lever 48. The fast idle cam projection 162 also contains a recess, not shown, in which is pressed a weight or ball of predetermined mass. The mass and its location is chosen such that the cam will always fall by gravity in a clockwise direction to follow the movement of tab 49 of lever 48. This will effect rotation of the fast idle cam clockwise progressively as the temperature of bimetal 68 increases.

The opposite side of cam 160 is formed with an edge 168 having a number of circumferentially contiguous steps including a high cam step 170 and a second or lower cam step 172. Each step in counterclockwise circumferential succession is defined by a face that is of less radial extent than the previous one, the lower step being followed by an opening 176. The steps and opening constitute abutments or stops in the path of movement of a screw 178. The screw is adjustably mounted on a lever 180 fixed on throttle shaft 38. The radial depth of opening 176 is chosen such that when the fast idle cam is rotated to engage the screw 178 in the opening 176, the throttle valve shaft will have rotated the throttle valve to its normal engine operating temperature level idle speed position essentially closing the throttle valve. Engagement of the screw 178 with each of the steps 172 and 170 as the cam rotates upon temperature decreases, then will progressively locate the idle speed position of the throttle valve at a more open position.

In this case, the fast idle cam is positioned on shaft 44 such that when lever 48 is in a rotative position as seen in FIG. 2 to just close the choke valve 28, the throttle stop 178 will engage the second step 172 of the fast idle cam, indicative of an intermediate cold ambient temperature condition of the engine. That is, the thermostatically coiled spring element 68 will have rotated the shaft 44 to a position that is intermediate the position obtained for the coldest engine operating temperature level and one in which the choke valve is completely open.

Thus, for an engine start at a temperature level below the normal operating level, but not one requiring the largest opening of the throttle valve to provide a greater air mass air/fuel mixture to the engine, the engine will be started with a mass flow more suitable to the temperature level obtained. Accordingly, when the thermostatically controlled spring element 68 is rotated counterclockwise to its coldest engine starting position, wherein the high cam step 170 would provide the throttle opening most suitable for this temperature level, this rotation of shaft 44 will cause a counterclockwise rotation of lever 48 pushing upwardly on link 52. Since the choke plate 28 is already closed, upward movement of link 52 will, once the overload of spring 57 is overcome, compress the spring and permit movement of the link 52 upwardly relative to the rod 56 to accommodate the rotation of the fast idle cam to engage the high cam step 170 with the throttle stop screw 178. When the engine is restarted, therefore, the pulldown piston 86 will first move link 52 downwardly to allow spring 57 to expand to its free state before moving link 52 further down to allow the choke valve to crack open. This opening will be less than when the engine is restarted with the fast idle cam step 172 positioned for the start up.

In general operation, therefore, it will be seen that the invention provides two different engine starting positions of the fast idle cam corresponding to a single closed choke plate position. When the ambient temperature level is only slightly below the normal engine operating temperature level, a large opening of the throttle plate for engine starting purposes is not desired since too great a mixture flow would occur. The invention solves this by permitting the throttle plate to be moved to a less open position by positioning the fast idle cam second step opposite the throttle stop screw. If, however, the ambient temperature level is low enough to require a greater throttle opening for engine starting, this also is accomplished by the fast idle cam rotating to locate its high cam step 170 opposite the throttle stop screw 178. This is permitted by the lost motion linkage 50 contracting the spring 57 compressing without causing a corresponding movement of the rod 56 and choke valve 28 from its closed choke plate position. The slots 54 in linkage 50 provide sufficient relative movement of rod 56 with respect to link 52 to accommodate the further rotation of the fast idle cam between the two steps.

From the foregoing it will be seen that the invention provides a choke mechanism permitting greater flexibility in starting a cold engine, which will thus provide better fuel economy and a more accurate control of the air/fuel ratio of the charge flowing to the engine.

While the invention has been shown and described in its preferred embodiment, it will be clear to those skilled in the arts to which it pertains that many changes and modifications may be made thereto without departing from the scope of the invention.

I claim:

1. A carburetor having an air/fuel induction passage open at one end to air at essentially atmospheric pressure and connected at its opposite end to an engine intake manifold to be subject to the changing vacuum levels therein, the one end having a choke valve rotatably mounted for movement across the passage between a closed air choking position and open inoperative position, and a throttle valve rotatably mounted posterior of the choke valve for movement across the passage between a normal essentially closed engine idle speed position and beyond towards a wide open throttle position to control the quantity of air/fuel mixture flow through the passage, an abutment means rotatable with the throttle valve, a rotatable fast idle cam having a high cam step projecting radially from the cam axes for engagement at times by the abutment means during movement of the throttle valve in a closing direction to stop the throttle valve in a more open position than the idle speed position to increase mixture flow to the manifold, the cam also having a second cam step of lesser radial projection engagable with the abutment means at other times as a function of the rotative position of the cam to stop the throttle valve in a less open position than the high cam step position but more open than the idle speed position, the cam being rotatable by gravity towards an inoperative position upon disengagement of the abutment means with the cam steps permitting closure of the throttle valve to the normal idle speed position, rotatable lever means secured to the choke valve and having a portion extending into the path of rotative movement of the fast idle cam towards the inoperative position to stop the cam rotation, a shaft, means rotatably mounting the fast idle cam on the shaft, means pivotally connecting the lever means to the choke valve, and means securing the shaft to the lever means and to a thermostatically responsive spring means urging the shaft and lever means in a choke closing direction upon decreases in temperature below the normal engine operating temperature level to abut the lever means portion with the fast idle cam and permit repositioning of the fast idle cam to a more open throttle valve position, the means connecting the lever means to the choke valve including lost motion means providing concurrent movement of the lever means and choke valve in a choke valve closing direction until the choke valve reaches its closed position and the fast idle cam second step is positioned to engage the abutment means, the lost motion means permitting subsequent relative movement between the lever means and choke valve to permit a rotation of the fast idle cam to engage the abutment means with the high cam step without necessitating a corresponding rotation of the choke valve.

2. A carburetor having an air/fuel induction passage open at one end to air at essentially atmospheric pressure and connected at its opposite end to an engine intake manifold to be subject to the changing vacuum levels therein, the one end having a rotatable choke valve unbalance mounted for movement by gravity and airflow thereagainst across the passage between a closed air choking position and a wide open inoperative position, and a throttle valve rotatably mounted posterior of the choke valve for movement across the passage between a normal essentially closed engine idle speed position at engine normal operating temperature levels and beyond towards a wide open throttle position to control the quantity of air/fuel mixture flow through the passage, a throttle lever having throttle stop abutment means thereon rotatable with the throttle valve, a rotatable fast idle cam having a circumferentially extending contoured cam surface with a plurality of steps of differing radial extend projecting radially from the cam axis and decreasing radially progressively in one circumferential direction, the steps being engagable individually at times by the abutment means during movement of the throttle valve in a closing direction to stop the throttle valve in a more open position than the normal idle speed position to increase mixture flow to the manifold, the stopped position of the throttle valve to an open position varying as a function of the rotative position of the cam, the cam also being rotatable by gravity towards an inoperative position in which the abutment means is disengaged from the cam surface permitting closure of the throttle valve to the normal idle speed position, and lost motion means interconnecting the choke valve and fast idle cam permitting movement of the choke valve to a closed position concurrent with movement of the fast idle cam to engage one of the steps of the cam surface with the abutment means followed by a further rotation of the cam to engage a more radially projecting step of the cam with the abutment means providing a more open position of the throttle valve then when engaged with the one step, without a further movement of the choke valve, a rotatable lever having a portion extending into the path of rotative movement of the fast idle cam towards the inoperative position to stop the cam rotation, the lost motion means including a pin and slot type operative interconnection between the choke valve and rotatable lever.

3. A carburetor as in claim 2, including means securing the lever to a thermostatically responsive spring means urging both the lever and choke valve in a choke valve closing direction upon decreases in temperature from the engine normal operating temperature level to abut the lever portion with the fast idle cam and rotate the fast idle cam towards the inoperative position.

* * * * *